US011617918B1

(12) United States Patent
Fuh et al.

(10) Patent No.: US 11,617,918 B1
(45) Date of Patent: Apr. 4, 2023

(54) ORAL REHABILITATION DEVICE

(71) Applicant: China Medical University, Taichung (TW)

(72) Inventors: Lih-Jyh Fuh, Taichung (TW); Yen-Wen Shen, Taichung (TW)

(73) Assignee: China Medical University, Taichung (TW)

( * ) Notice: Subject to any disclaimer, the term of this patent is extended or adjusted under 35 U.S.C. 154(b) by 0 days.

(21) Appl. No.: 17/584,526

(22) Filed: Jan. 26, 2022

(30) Foreign Application Priority Data

Oct. 15, 2021 (TW) ..... 110138316

(51) Int. Cl.
*A63B 23/03* (2006.01)

(52) U.S. Cl.
CPC ..... *A63B 23/032* (2013.01); *A63B 2209/00* (2013.01); *A63B 2225/62* (2013.01)

(58) Field of Classification Search
CPC ..... A63B 23/032; A63B 2209/00; A63B 2225/62; A63B 21/021; A63B 2022/0092; A61H 23/004; A61H 2201/1604; A61H 2205/02; A61H 2201/165
See application file for complete search history.

(56) References Cited

U.S. PATENT DOCUMENTS 2,685,287 A * 8/1954 Golfier ..... A61H 13/00 128/DIG. 20
3,091,237 A * 5/1963 Skinner ..... A61H 9/0078 128/DIG. 20
3,447,534 A * 6/1969 Erwin ..... A63B 23/032 601/151
3,528,655 A * 9/1970 Ruderian ..... A63B 23/032 482/11
4,666,148 A * 5/1987 Crawford ..... A63B 23/03 482/901
5,562,105 A * 10/1996 Syrop ..... A63B 23/032 128/845
5,577,983 A * 11/1996 Fraser ..... A63B 23/032 433/140
5,899,691 A * 5/1999 Parker ..... A61F 5/566 601/38
6,406,404 B1 * 6/2002 Chu ..... A63B 23/032 482/124
6,494,209 B2 * 12/2002 Kulick ..... A61F 5/566 128/859
6,524,225 B1 * 2/2003 Arias ..... A63B 23/032 482/11
7,083,548 B1 * 8/2006 Moore ..... A63B 23/032 482/11

(Continued)

*Primary Examiner* — Garrett K Atkinson

(57) ABSTRACT

According to the present disclosure, an oral rehabilitation device includes an air bladder and a pumping member. The air bladder includes a cheek-side membrane and a teeth-side membrane, and the cheek-side membrane and the teeth-side membrane are arranged opposite to each other. The pumping member is communicated with the air bladder, and the pumping member is configured for inflating the air bladder. The cheek-side membrane and the teeth-side membrane extend toward the outside of the air bladder when the pumping member is inflating the air bladder, and an extension of the cheek-side membrane is larger than an extension of the teeth-side membrane.

14 Claims, 6 Drawing Sheets

(56) References Cited

U.S. PATENT DOCUMENTS

| | | | | |
|---|---|---|---|---|
| 7,238,145 | B2 * | 7/2007 | Robbins | A63B 21/0004 482/122 |
| 7,857,831 | B2 * | 12/2010 | Ishikawa | A63B 23/18 606/234 |
| 7,955,221 | B2 * | 6/2011 | Loveday | A63B 23/03 482/121 |
| 8,105,210 | B2 * | 1/2012 | Seybold | A63B 23/032 433/140 |
| 8,376,912 | B1 * | 2/2013 | Dedvukaj | A63B 21/028 482/148 |
| 9,468,801 | B2 * | 10/2016 | Matsushita | A63B 21/0023 |
| 2010/0222706 | A1 * | 9/2010 | Miyahara | A61B 5/22 600/590 |

* cited by examiner

ORAL REHABILITATION DEVICE

RELATED APPLICATIONS

This application claims priority to Taiwan Application Serial Number 110138316, filed Oct. 15, 2021, which is herein incorporated by reference.

BACKGROUND

Technical Field

The present disclosure relates to an oral rehabilitation device. More particularly, the present disclosure relates to an oral rehabilitation device for training the muscles or mucosae of both cheeks.

Description of Related Art

Oral submucous fibrosis (OSF) is a chronic oral mucosal lesion, which may be caused by bad eating habits (such as chewing betel nuts), immune problems, lacks of specific nutrients or genetic factors. Patients with oral submucous fibrosis are prone to atrophy and keratinization of oral mucosal epithelium, and hyaline of submucosa or accumulation of collagen fibers may happen. It would lead to degeneration of muscle fibers around the mouth and stiffness of oral mucosa, which may eventually affect the functions of mouth opening and closing, chewing and swallowing of the patients.

The current treatments of oral submucous fibrosis mainly include drug administration, surgery, diet control and rehabilitation. Patients with mild fibrosis symptoms or received surgeries can undergo an oral rehabilitation to improve the opening of mouth thereof. Oral rehabilitation is to help the patients exercise their mouth with different degrees of opening and closing by the professional devices. However, the muscles of both cheeks can only stretch vertically when using the conventional mouth opening device, and the flexibility of muscles or mucosae of both cheeks cannot be effectively restored. Thus, the patients after rehabilitation still face lots of problems and difficulties during daily oral cleaning, regular dental check-up or denture fabrication and treatment. The patients are unable to obtain good oral hygiene and high treatment quality, which may cause other dental and periodontal problems.

In this regard, it is still an unsolved problem to help the patients restore the flexibility and perform horizontal stretching of the muscles or mucosae of both cheeks.

SUMMARY

According to the present disclosure, an oral rehabilitation device includes an air bladder and a pumping member. The air bladder includes a cheek-side membrane and a teeth-side membrane, and the cheek-side membrane and the teeth-side membrane are arranged opposite to each other. The pumping member is communicated with the air bladder, and the pumping member is configured for inflating the air bladder. The cheek-side membrane and the teeth-side membrane extend toward the outside of the air bladder when the pumping member is inflating the air bladder, and an extension of the cheek-side membrane is larger than an extension of the teeth-side membrane.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
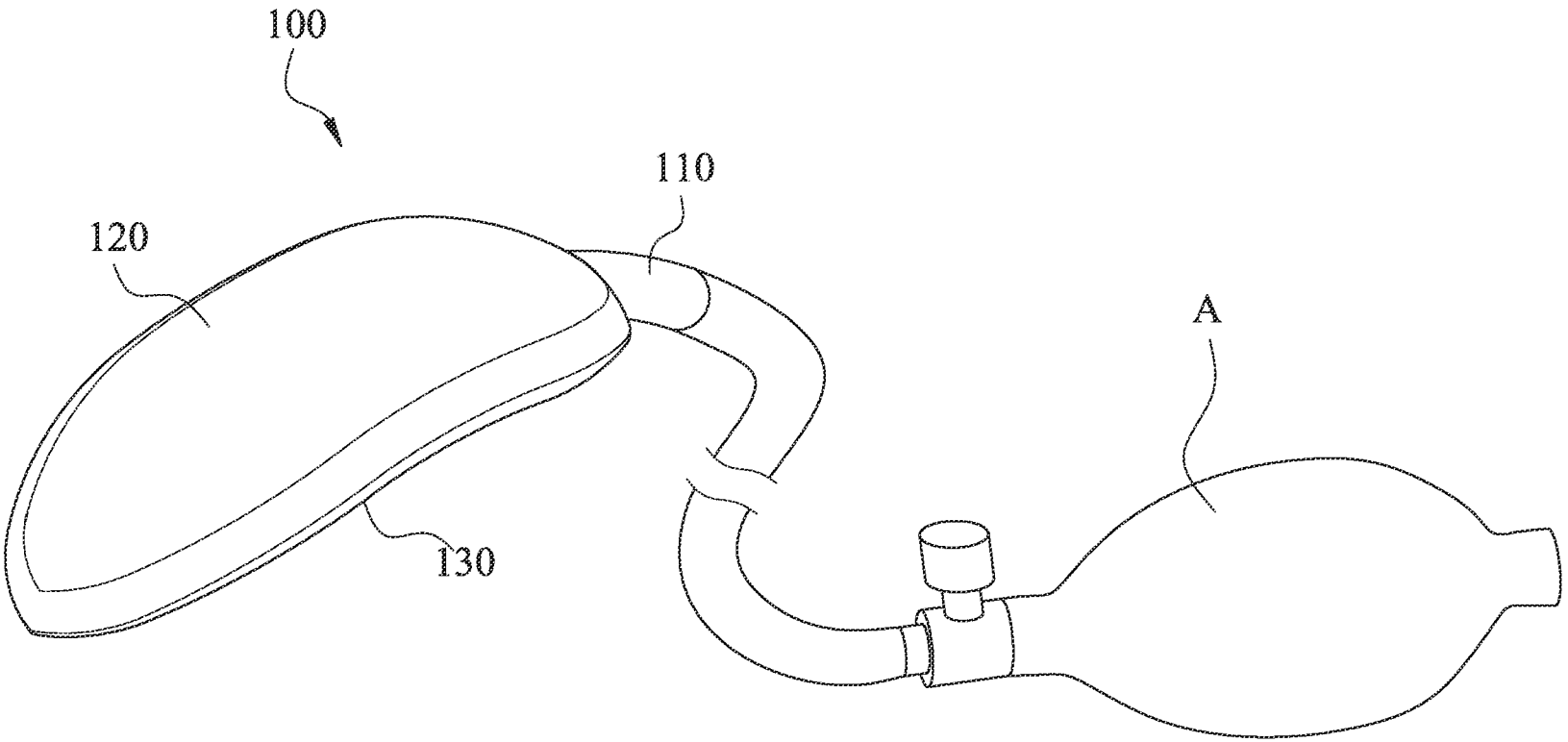
FIG. 1 is a three-dimensional schematic view of an oral rehabilitation device according to the 1st example of the present disclosure.

The present disclosure will be further exemplified by the following specific embodiments. However, the embodiments can be applied to various inventive concepts and can be embodied in various specific ranges. The specific embodiments are only for the purposes of description, and are not limited to these practical details thereof. Furthermore, in order to simplify the drawings, some conventional structures and elements will be illustrated in the drawings by a simple and schematic way. The duplicated elements may be denoted by the same number or similar numbers.

Please refer to FIG. 1. FIG. 1 is a three-dimensional schematic view of an oral rehabilitation device according to the 1st example of the present disclosure. The oral rehabilitation device includes an air bladder 100 and a pumping member A. The pumping member A is communicated with the air bladder 100, and the pumping member A is configured for inflating the air bladder 100. The pumping member A can be communicated with the air bladder 100 through an inflating opening 110. In the present example, the pumping member A is a pumping bulb. In other examples, the pumping member can also be any other inflating device, and can be connected to other electronic devices to achieve the functions such as automatic inflation and deflation or monitoring the pressure values. However, the types and functions of the pumping member are not limited in the present disclosure.

The air bladder 100 includes a cheek-side membrane 120 and a teeth-side membrane 130, and the cheek-side membrane 120 and the teeth-side membrane 130 are arranged opposite to each other. When the patient is undergoing the rehabilitation, the cheek-side membrane 120 will fit the inner side of the cheek, and the teeth-side membrane 130 will abut the side of teeth and gums. The operation of the oral rehabilitation device will be introduced in the following paragraphs, and further details would not be given herein. The air bladder 100 can be made of any elastic material having biocompatibility. For example, the air bladder 100 can be made of an elastic material for medical uses which does not affect human health, such as styrenic block copolymer (SBC), thermoplastic polyolefin (TPO), thermoplastic vulcanized rubber (TPV), thermoplastic polyurethane (TPU), thermoplastic copolyester (TPE-E), thermoplastic polyamide (TPE-A), natural rubber or silicone, and the present disclosure is not limited thereto. Preferably, the air bladder 100 can be made of silicone, and a Shore hardness of the silicone can be 40 A-70 A. The air bladder 100 made of silicone can be sterilized under high temperature and have great elasticity and extending ratio. It ensures that the air bladder 100 will not be deformed after repeatedly inflation and deflation, and the comfortable feeling increases as the mouth touching the air bladder 100.

Figure 2B:
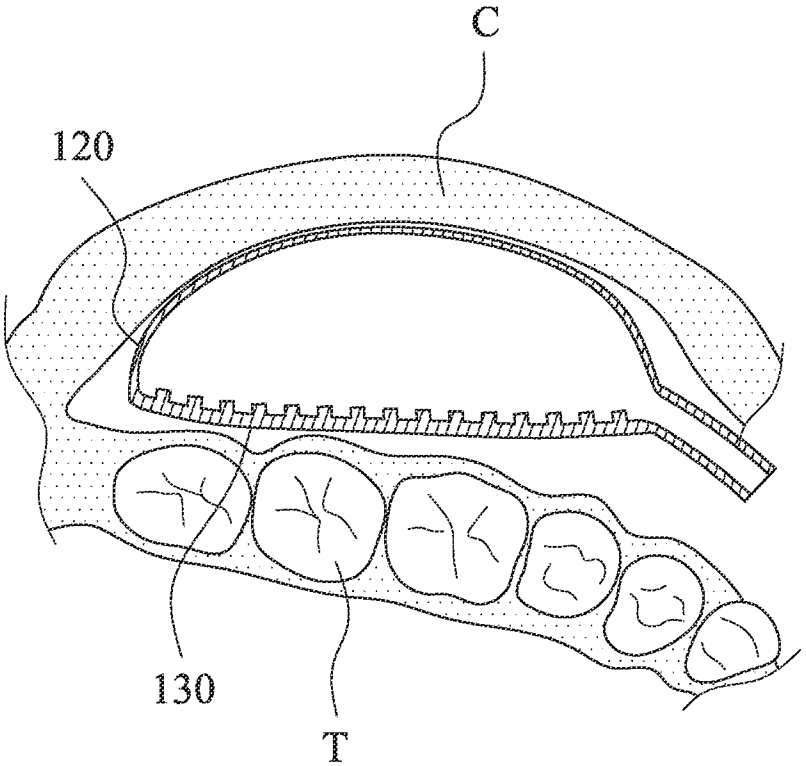
FIG. 2B is a sectional schematic view of the air bladder of FIG. 1 after inflating.
Figure 2A:
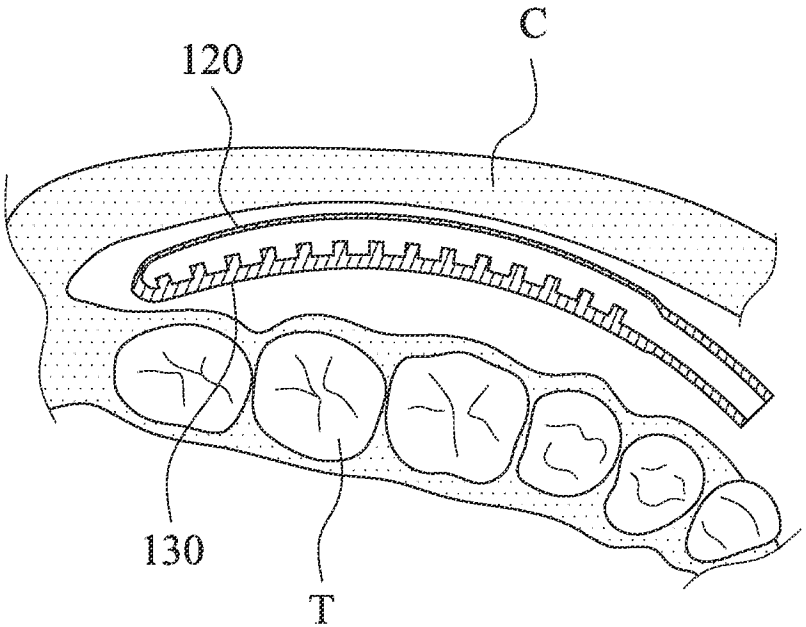
FIG. 2A is a sectional schematic view of the air bladder of FIG. 1 before inflating.

Please refer to FIG. 2A and FIG. 2B. FIG. 2A is a sectional schematic view of the air bladder 100 of FIG. 1 before inflating. FIG. 2B is a sectional schematic view of the air bladder 100 of FIG. 1 after inflating. As using the oral rehabilitation device, the cheek-side membrane 120 of the air bladder 100 faces the buccinator muscle C of the patient, and the teeth-side membrane 130 thereof faces the teeth T of the patient. When the pumping member A is inflating the air bladder 100, the cheek-side membrane 120 and the teeth-side membrane 130 extend toward the outside of the air bladder 100. Therefore, the buccinator muscle C can be pushed and then stretches toward the outside of the face, so the buccinator muscle C is able to undergo the rehabilitation by stretching in a horizontal direction.

Please note that, from FIG. 2B, an extension of the cheek-side membrane 120 is larger than an extension of the teeth-side membrane 130 when the air bladder 100 is being inflated. Moreover, a ratio of a deformation of the teeth-side membrane 130 to a deformation of the cheek-side membrane 120 can be 20%-60% when the air bladder 100 is fully inflated. Through changing the extensions of the cheek-side membrane 120 and the teeth-side membrane 130, the expansion of the air bladder 100 toward the outside of the face can be larger, which effectively helps the buccinator muscle C stretch. The expanded part of the air bladder 100 is mainly at the center of the cheek-side membrane 120, so the stretch of the buccinator muscle C at the center of the cheek can be larger, and the buccinator muscle C adjacent to the lips or molars would not over stretch. Thus, the comfortable feeling increases during the rehabilitation.

When the air bladder 100 is made of silicone, the extensions of the cheek-side membrane 120 and the teeth-side membrane 130 can be different by changing the thicknesses of the cheek-side membrane 120 and the teeth-side membrane 130. Preferably, a thickness of the teeth-side membrane 130 can be 4 times to 9 times as large as a thickness of the cheek-side membrane 120. The thickness of the cheek-side membrane 120 can be 0.2 mm-0.5 mm, and the thickness of the teeth-side membrane 130 can be 1.0 mm-1.5 mm. Therefore, it not only ensures that the extension of the cheek-side membrane 120 is larger than the extension of the teeth-side membrane 130 when the air bladder 100 is being inflated, but also provides enough spaces for the air bladder 100 to expand with suitable membrane thicknesses, which give enough stretch to the buccinator muscle C.

Figure 3:
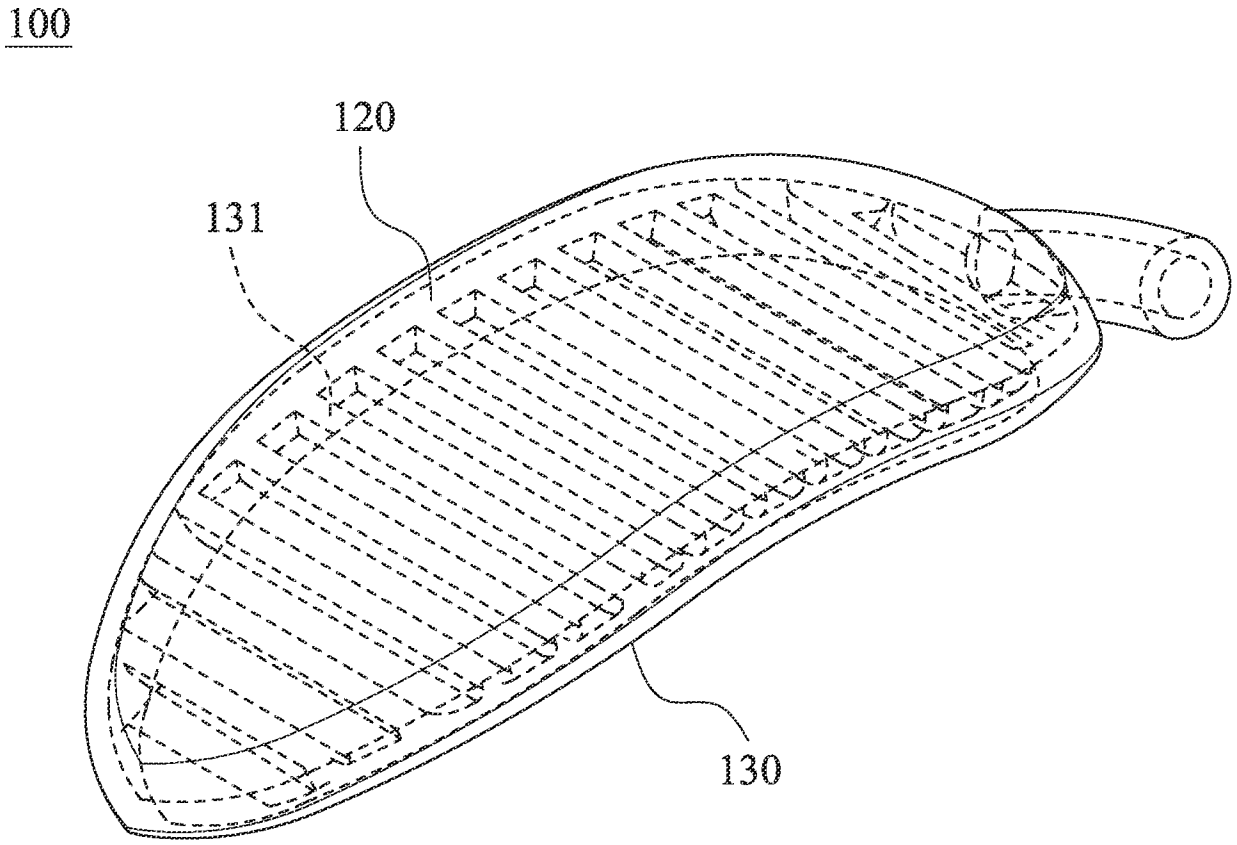
FIG. 3 is a perspective schematic view of the air bladder of FIG. 1.

Please refer to FIG. 3. FIG. 3 is a perspective schematic view of the air bladder 100 of FIG. 1. In FIG. 3, an inner side of the teeth-side membrane 130 can have a plurality of rib-like protruding structures 131, and the plurality of rib-like protruding structures 131 can be arranged in parallel or into a mesh. The tensile strength of the teeth-side membrane 130 can be improved by having the plurality of rib-like protruding structures 131. When the air bladder 100 is being inflated, the expansion of the teeth-side membrane 130 can be more effectively prevented, and the difference between the extensions of the cheek-side membrane 120 and the teeth-side membrane 130 can be further enhanced. The correlation between the arrangement density of the plurality of rib-like protruding structures 131 and the elasticity of the teeth-side membrane 130 is negative. A distance between two of the plurality of rib-like protruding structures 131 adjacent to each other can be 1.5 mm-4.12 mm, so as to provide suitable flexibility as preventing the expansion of the teeth-side membrane 130. Thus, the comfortable feeling can increase as the teeth and gums touching the teeth-side membrane 130.

Figure 4:
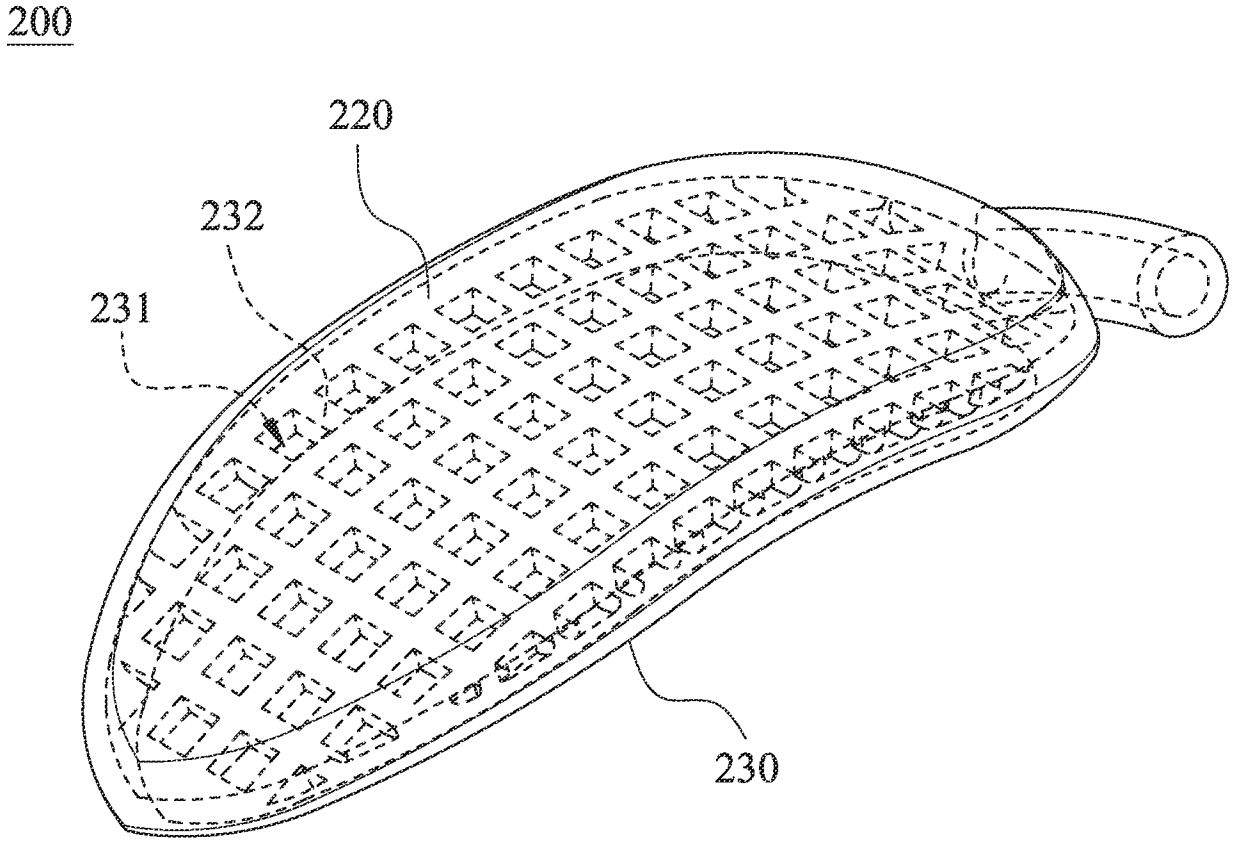
FIG. 4 is a perspective schematic view of an air bladder of an oral rehabilitation device according to the 2nd example of the present disclosure.

Please refer to FIG. 4. FIG. 4 is a perspective schematic view of an air bladder 200 of an oral rehabilitation device according to the 2nd example of the present disclosure. The structure of the air bladder 200 of the 2nd example is similar to the structure of the air bladder 100 of the 1st example, and the difference thereof is that, an inner side of the teeth-side membrane 230 of the air bladder 200 can have a plurality of blind holes 231, and the plurality of blind holes 231 can be dispersed over the inner side of the teeth-side membrane 230. Through arranging the plurality of blind holes 231, a mesh-like protruding structure 232 will relatively formed at the inner side of the teeth-side membrane 230. The expansion of the teeth-side membrane 230 can also be prevented by the mesh-like protruding structure 232, and the tensile force of the teeth-side membrane 230 can be uniformly spread out by the mesh-like protruding structure 232, which can effectively enhance the stability of the teeth-side membrane 230 extension. The correlation between the arrangement density of the plurality of blind holes 231 and the elasticity of the teeth-side membrane 230 is positive. A distance between two of the plurality of blind holes 231 adjacent to each other can be 1.5 mm-10 mm, which avoids the plurality of blind holes 231 being too close to each other, and the tensile strength of the teeth-side membrane 230 and the difference between the extensions of the cheek-side membrane 220 and the teeth-side membrane 230 can be maintained.

Figure 5:
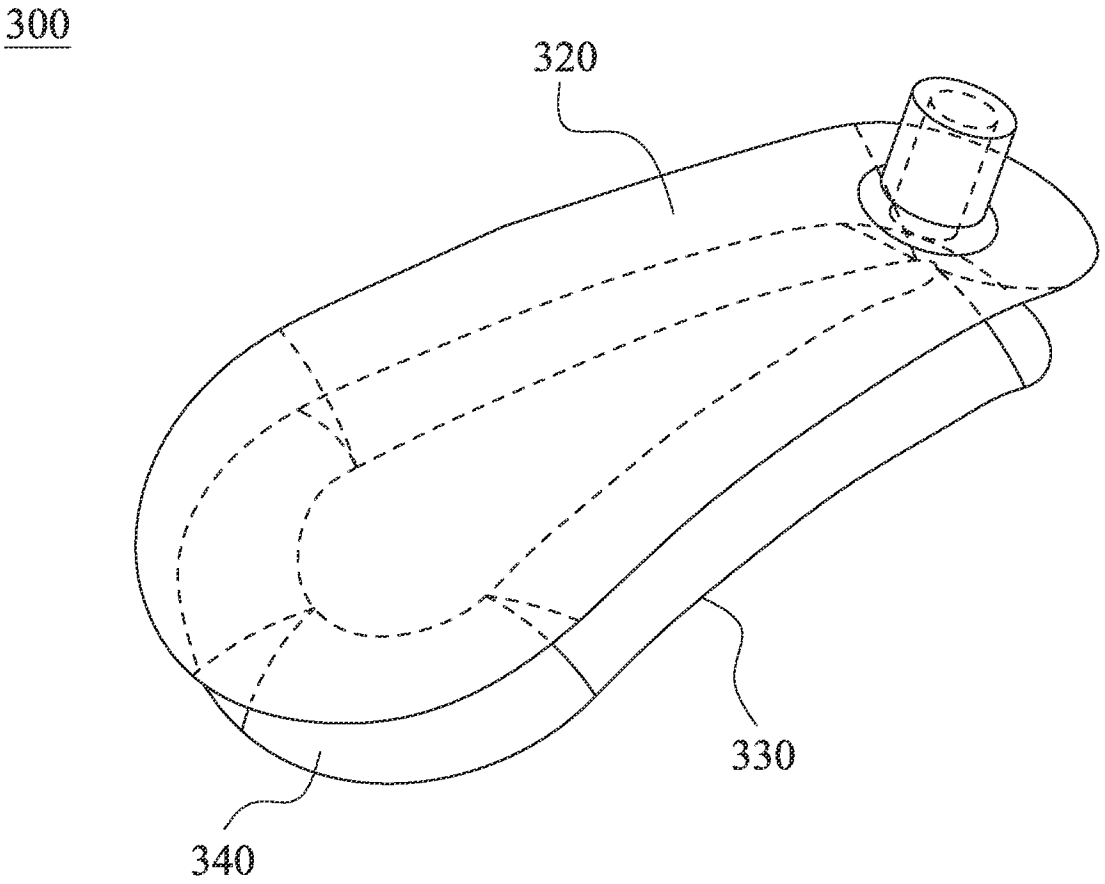
FIG. 5 is a three-dimensional schematic view of an air bladder of an oral rehabilitation device according to the 3rd example of the present disclosure.
Figure 6A:
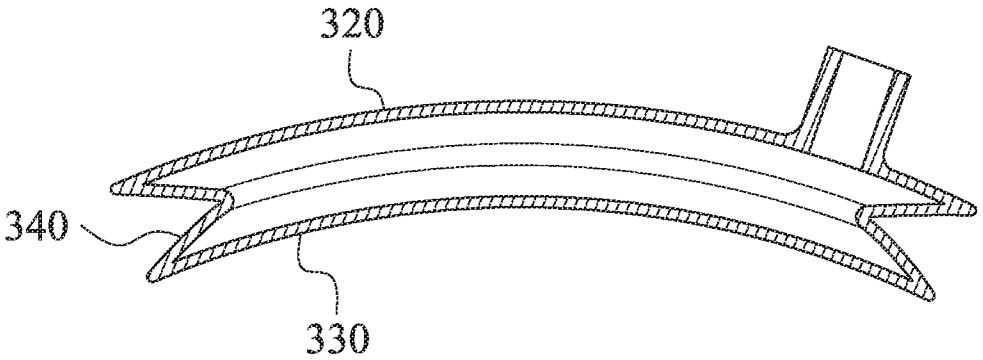
FIG. 6A is a sectional schematic view of the air bladder of FIG. 5 before inflating.
Figure 6B:
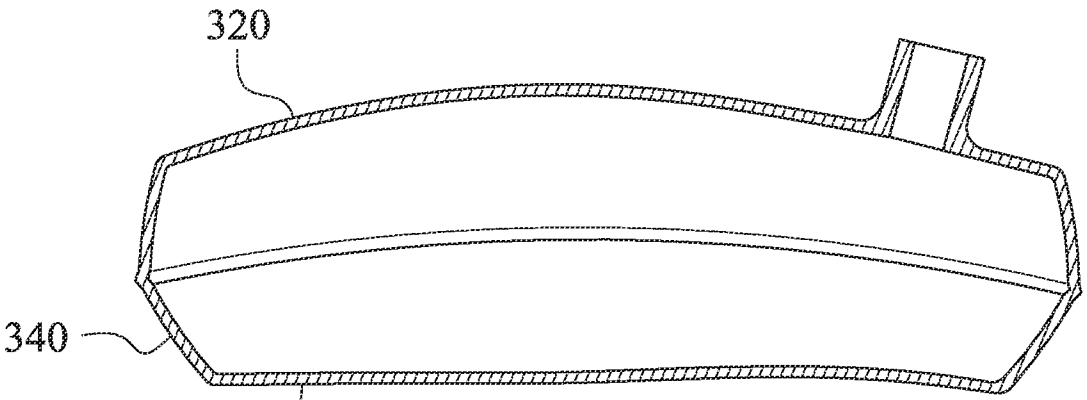
FIG. 6B is a sectional schematic view of the air bladder of FIG. 5 after inflating.

Please refer to FIG. 5, FIG. 6A and FIG. 6B. FIG. 5 is a three-dimensional schematic view of an air bladder 300 of an oral rehabilitation device according to the 3rd example of the present disclosure. FIG. 6A is a sectional schematic view of the air bladder 300 of FIG. 5 before inflating. FIG. 6B is a sectional schematic view of the air bladder 300 of FIG. 5 after inflating. The structure of the air bladder 300 of the 3rd example is similar to the structures of the air bladder 100 of the 1st example and the air bladder 200 of the 2nd example, and the difference thereof is that, the air bladder 300 can further include a surrounding membrane 340, and the surrounding membrane 340 is connected to the cheek-side membrane 320 and the teeth-side membrane 330. In FIG. 6A and FIG. 6B, the surrounding membrane 340 can plump up toward the outside of the air bladder 300 when the air bladder 300 is being inflated, and the expansion of the air bladder 300 can be enhanced. Therefore, larger stretch of the buccinator muscle can be obtained by using the air bladder 300 of the 3rd example, which is more suitable for the patient undergoing the late rehabilitation. The surrounding membrane 340 can be a foldable structure, and the volume of the air bladder 300 before inflating can be significantly reduced, which is favorable for the storage of the air bladder 300.

A volume of gas in the air bladder 300 can be 45 mL-50 mL when the air bladder 300 is fully inflated, and an inflated overall deformation of the surrounding membrane 340 can be 375%-395%. When the air bladder 300 is made of silicone, whose Shore hardness is 40 A-70 A, a thickness of the surrounding membrane 340 can be 0.5 mm-0.8 mm. Thus, it ensures that the surrounding membrane 340 has enough tensile strength, and prevents the over expansion of the surrounding membrane 340 toward the outside of the air bladder 300. The expansion direction of the air bladder 300 can be controlled to effectively help the buccinator muscle stretch.

In this regard, the oral rehabilitation device of the present disclosure includes the air bladder, which can be arranged between the inner side of the cheek and the teeth of the patient. By inflating the air bladder, the buccinator muscles of the patient can be pushed to stretch toward the outside of the face, so as to help the muscles and mucosae of both cheeks become flexible again. Furthermore, through changing the extensions of the cheek-side membrane and the teeth-side membrane, the expansion of the air bladder toward the outside of the face can be larger, which effectively improves the stretch of the muscles of both cheeks.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An oral rehabilitation device, comprising:

an air bladder configured to be inserted into a user's mouth between a user's cheek and teeth to facilitate exercise of the user's cheek, said air bladder, comprising:

a cheek-side membrane; and a teeth-side membrane, wherein the cheek-side membrane and the teeth-side membrane are arranged opposite to each other; and a pumping member communicated with the air bladder, wherein the pumping member is configured for inflating the air bladder;

wherein the cheek-side membrane and the teeth-side membrane extend toward the outside of the air bladder when the pumping member is inflating the air bladder, and an extension of the cheek-side membrane is larger than an extension of the teeth-side membrane.

2. The oral rehabilitation device of claim 1, wherein a ratio of a deformation of the teeth-side membrane to a deformation of the cheek-side membrane is 20%-60% when the air bladder is fully inflated.

3. The oral rehabilitation device of claim 1, wherein the air bladder is made of an elastic material, and the elastic material is styrenic block copolymer, thermoplastic polyolefin, thermoplastic vulcanized rubber, thermoplastic polyurethane, thermoplastic copolyester, thermoplastic polyamide, natural rubber or silicone.

4. The oral rehabilitation device of claim 3, wherein the elastic material is silicone, and a Shore hardness of the elastic material is 40 A-70 A.

5. The oral rehabilitation device of claim 4, wherein a thickness of the teeth-side membrane is 4 times to 9 times as large as a thickness of the cheek-side membrane.

6. The oral rehabilitation device of claim 4, wherein a thickness of the cheek-side membrane is 0.2 mm-0.5 mm.

7. The oral rehabilitation device of claim 4, wherein a thickness of the teeth-side membrane is 1.0 mm-1.5 mm.

8. The oral rehabilitation device of claim 1, wherein an inner side of the teeth-side membrane has a plurality of rib-like protruding structures, and the plurality of rib-like protruding structures are arranged in parallel or into a mesh.

9. The oral rehabilitation device of claim 8, wherein a distance between two of the plurality of rib-like protruding structures adjacent to each other is 1.5 mm-4.12 mm.

10. The oral rehabilitation device of claim 1, wherein an inner side of the teeth-side membrane has a plurality of blind holes, and the plurality of blind holes are dispersed over the inner side of the teeth-side membrane.

11. The oral rehabilitation device of claim 10, wherein a distance between two of the plurality of blind holes adjacent to each other is 1.5 mm-10 mm.

12. The oral rehabilitation device of claim 1, wherein the air bladder further comprises a surrounding membrane, the surrounding membrane is connected to the cheek-side membrane and the teeth-side membrane, a volume of gas in the air bladder is 45 mL-50 mL when the air bladder is fully inflated, and an inflated overall deformation of the surrounding membrane is 375%-395%.

13. The oral rehabilitation device of claim 12, wherein the air bladder is made of an elastic material, and the elastic material is styrenic block copolymer, thermoplastic polyolefin, thermoplastic vulcanized rubber, thermoplastic polyurethane, thermoplastic copolyester, thermoplastic polyamide, natural rubber or silicone.

14. The oral rehabilitation device of claim 13, wherein the elastic material is silicone, a Shore hardness of the elastic material is 40 A-70 A, and a thickness of the surrounding membrane is 0.5 mm-0.8 mm.

* * * * *